US006179151B1

(12) United States Patent
Radvansky et al.

(10) Patent No.: US 6,179,151 B1
(45) Date of Patent: Jan. 30, 2001

(54) GARBAGE CONTAINER

(76) Inventors: Todd Radvansky; Maria Stewart, both of 8575 Apple Hill Rd., Chagrin Falls, OH (US) 44023

( * ) Notice: Under 35 U.S.C. 154(b), the term of this patent shall be extended for 0 days.

(21) Appl. No.: 09/472,514

(22) Filed: Dec. 27, 1999

(51) Int. Cl.[7] ..... B65F 1/12
(52) U.S. Cl. ..... 220/495.06; 220/908; 220/4.23
(58) Field of Search ..... 220/908, 908.1, 220/495.06, 495.08, 495.11, 6, 4.22, 4.23; 232/43.1

(56) References Cited

U.S. PATENT DOCUMENTS

| | | | | |
|---|---|---|---|---|
| D. 349,997 | | 8/1994 | Ullmann . | |
| 2,602,584 | * | 7/1952 | Croff . | |
| 4,195,744 | * | 4/1980 | Christianson | 220/1.5 |
| 4,218,103 | * | 8/1980 | Bacskay | 312/211 |
| 4,923,080 | | 5/1990 | Lounsbury . | |
| 4,955,497 | | 9/1990 | Winden et al. . | |
| 4,972,950 | * | 11/1990 | Shillington | 206/366 |
| 5,011,026 | * | 4/1991 | Hausman et al. | 209/675 |
| 5,195,501 | | 3/1993 | Ault . | |
| 5,361,978 | | 11/1994 | Monroe . | |
| 5,372,271 | | 12/1994 | Miller et al. . | |
| 5,381,921 | | 1/1995 | Bray et al. . | |
| 5,490,604 | * | 2/1996 | Alexander | 220/4.34 |
| 5,540,351 | | 7/1996 | Luescher . | |
| 5,836,470 | * | 11/1998 | Neelly et al. | 220/4.22 |
| 5,901,872 | | 5/1999 | Zollinhofer et al. . | |
| 6,056,177 | * | 5/2000 | Schneider | 224/401 |

FOREIGN PATENT DOCUMENTS

| | | | | |
|---|---|---|---|---|
| 3233824 | * | 3/1984 | (DE) | 220/908 |
| 2105577 | | 3/1983 | (GB) . | |

* cited by examiner

*Primary Examiner*—Stephen Castellano
(74) *Attorney, Agent, or Firm*—Richard C. Litman

(57) ABSTRACT

An improved garbage or refuse container having a substantially rectangular shaped container with blunt or smooth edges. The container includes a top portion, bottom portion and body portion for retaining refuse. The body portion forms the walls of the container and includes a door having at least one fastening mechanism integrally disposed therein for securing the door to the body portion. The door is contiguously and pivotally formed or joined with the body as a single material element. A receiving portion of the body with the door also includes a retaining plate or lip on a separate and opposing end of the body and is formed also as a single contiguous material element with the body for matingly receiving and retaining the door in a closed configuration along a peripheral edge portion. Proximate and adjacent the retaining lip is disposed within the body at least one connector element for respectively connecting thereto at least one snap fastener. The body when in the closed configuration operatively provides a top retainer ledge within the top portion for retaining a trash bag liner, and a top lid. The lid includes a single spherical handle portion as a gripping surface for removably placing the lid to top portion. The container over all is light weight and simple to clean and use with minimized mechanical elements.

7 Claims, 2 Drawing Sheets

GARBAGE CONTAINER

BACKGROUND OF THE INVENTION

1. Field of the Invention

The present invention relates generally to refuse containers. More specifically, the invention is an improved indoor garbage receptacle adapted for lateral trash removal via a removable door integrally formed therewith and releasably secured by a set of snap fasteners.

2. Description of the Related

Numerous garbage or refuse containers have been devised for providing a convenient and sanitary way of disposing waste. The convenience is directly related to the structural features of conventional refuse containers and there ease of use. Other factors have been directed simply to aesthetic features such as shapes, design, color etc. to optimize coordinating qualities directed to the placement of a refuse container in a particular room or environment. The balance between these two particular problems has been the driving force behind improving what some may consider irrelevant features in most garbage containers. While the above issues may not accentuate the need for improved refuse containers, users young and old have wrestled with the difficulty in manipulating conventional refuse containers which are either bulky, heavy or unbearable in removing garbage from the container in a home to a curbside or the like for proper disposal.

For example, children who's first chore in most instances is taking out the garbage have become stymied at this task of properly disposing refuse because of fear of contamination, difficulty in vertically removing refuse or simply having difficulty manipulating and/or cleaning an otherwise bulky, heavy and complex refuse container with multiple mechanical parts. Other disadvantages of the conventional refuse containers as described below involves the use of moveable mechanical parts which are prone to rust, discoloration and other material degrading effects associated with mechanical wear. An improved refuse container which is simple to manipulate, lightweight, structurally rigid with minimized mechanical elements as herein describe is lacking.

For example, U.S. Pat. No. 4,923,080 issued to Lounsbury discloses a trash receptacle formed from a hollow body member having a door interconnected thereto as a separate element via a mechanical hinge and pin connection. Cooperating latch members are disposed on the door for retaining the door in a closed position. An interior floor is pivotally mounted within the receptacle and inclined or activated via a foot latch disposed and protruding at its base. U.S. Pat. No. 5,372,271 discloses a waste disposal bin of conventional construction which also utilizes a pedal actuated mechanism for activating a trash disposal feature of the container.

U.S. Pat. No. 4,955,497 issued to Winden et al discloses a litter container comprising an arcuate door disposed within a cylindrical body. The door comprises a substantially 180 degree arcuate section of the cylindrical container. A similar mechanical hinge and pin connection is used to retain the door to the container as a separate cantilevered door element. A centrally disposed aperture is formed within a domed shaped top of the container for depositing trash therethrough to a metal basket housed therein as a removable basket.

U.S. Pat. No. 5,195,501 issued to Ault discloses a refuse burner barrel apparatus comprising a semi-cylindrical first shell mounting a semi-cylindrical second shell which functions as a door with respect the first shell. The two shells are attached via a mechanical hinge and pin connection, and a powdered aggregate is contained within spaced walls of the first shell, including upper and lower semi-cylindrical caps mounted to upper and lower distal ends of the first shell for enclosing aggregated there within. The second shell further includes a sliding door to permit drafting through the interior cavity of the first and second shell when in a cylindrical configuration, with a wire-mesh basket removably mounted thereto. When the door is opened the basket is easily removed relative to first shell.

U.S. Pat. No. 5,901,872 issued to Zollinhofer et al. discloses a trash containers with a sump and side door. The trash container is a cylindrically shaped metal container having the door mounted thereon via a mechanical hinge and pin connection. The external base portion includes a plurality of wheels mounted thereto for rolling transport to various locations. Within the interior of the bottom portion of the container a centrally dispose medium is loped therein to provide a sump on either side of the medium for retaining liquid from leaking bags.

U.S. Pat. No. 5,361,978 issued to Monroe discloses a waste receptacle similarly supported on wheels or casters an in turn supports three orthogonal upright walls forming an interior trash receiving space. A trash receiving member comprises a first wall which serves as a receptacle sidewall in a trash receiving state. A handle is secured to an upper portion of the first wall for manually pulling the first wall down to a substantially horizontal trash removal state about a pivot axis. In this state, the end wall is shifted to overhang the first wall and shifts a trashbag onto the first wall external the interior volume of the inner compartment or upright walls.

U.S. Pat. No. 5,381,921 issued to Bray et al. discloses a refuse container similar to that taught by Monroe comprising a hollow body with an upper access opening closed by a pivoting cover. A bag suspension frame carried by a body wall pivotally connected at the base and is movable from the front to extend between 40 and 65 degrees for bag removal.

Other Patents issued to Luescher (U.S. Pat. No. 5,540,351), Lee et al. (UK 2105577) and Ulmann (Des. 349,997) are considered to be of general relevance to the refuse container as herein described and having conventional structural features common in the relevant art.

None of the above inventions and patents, taken either singularly or in combination, is seen to describe the instant invention as claimed. Thus a garbage or refuse container solving the aforementioned problems is desired.

SUMMARY OF THE INVENTION

The improved garbage or refuse container according to invention has a substantially rectangular shaped container with blunt or smooth edges. The container includes a top portion, bottom portion and body portion for retaining refuse. The body portion forms the walls of the container and includes a door having at least one fastening mechanism integrally disposed therein for securing the door to the body portion. The door is contiguously and pivotally formed or joined with the body as a single material element. A receiving portion of the body with the door also includes a retaining plate or lip on a separate and opposing end of the body and is formed also as a single contiguous material element with the body for matingly receiving and retaining the door in a closed configuration along a peripheral edge portion. Proximate and adjacent the retaining lip is disposed within the body at least one connector element for respectively connecting thereto at least one snap fastener. The body when in the closed configuration operatively provides a top retainer ledge within the top portion for retaining a trash bag liner, and a top lid. The lid includes a single spherical handle portion as a gripping surface for removably placing the lid to top portion. The container over all is light weight and simple to clean and use with minimized mechanical elements.

Accordingly, it is a principal object of the invention to provide an improved refuse container for laterally removing refuse in combination with a trash bag or liner.

It is another object of the invention to provide an improved refuse container which is made of light-weight plastic material.

It is a further object of the invention to provide an improved refuse container which is simple to use with minimized single mechanical parts.

Still another object of the invention is to provide an improved refuse container which is structurally rigid and impervious to moisture ladened effects which produces material degradation such as rust, corrosion, etc.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to an improved garbage or refuse container for conveniently storing and removing refuse G with minimized physical exertion by a user U. The preferred embodiment of the invention is depicted in FIGS. 1–2, and is generally referenced by numeral 3.

Figure 1:
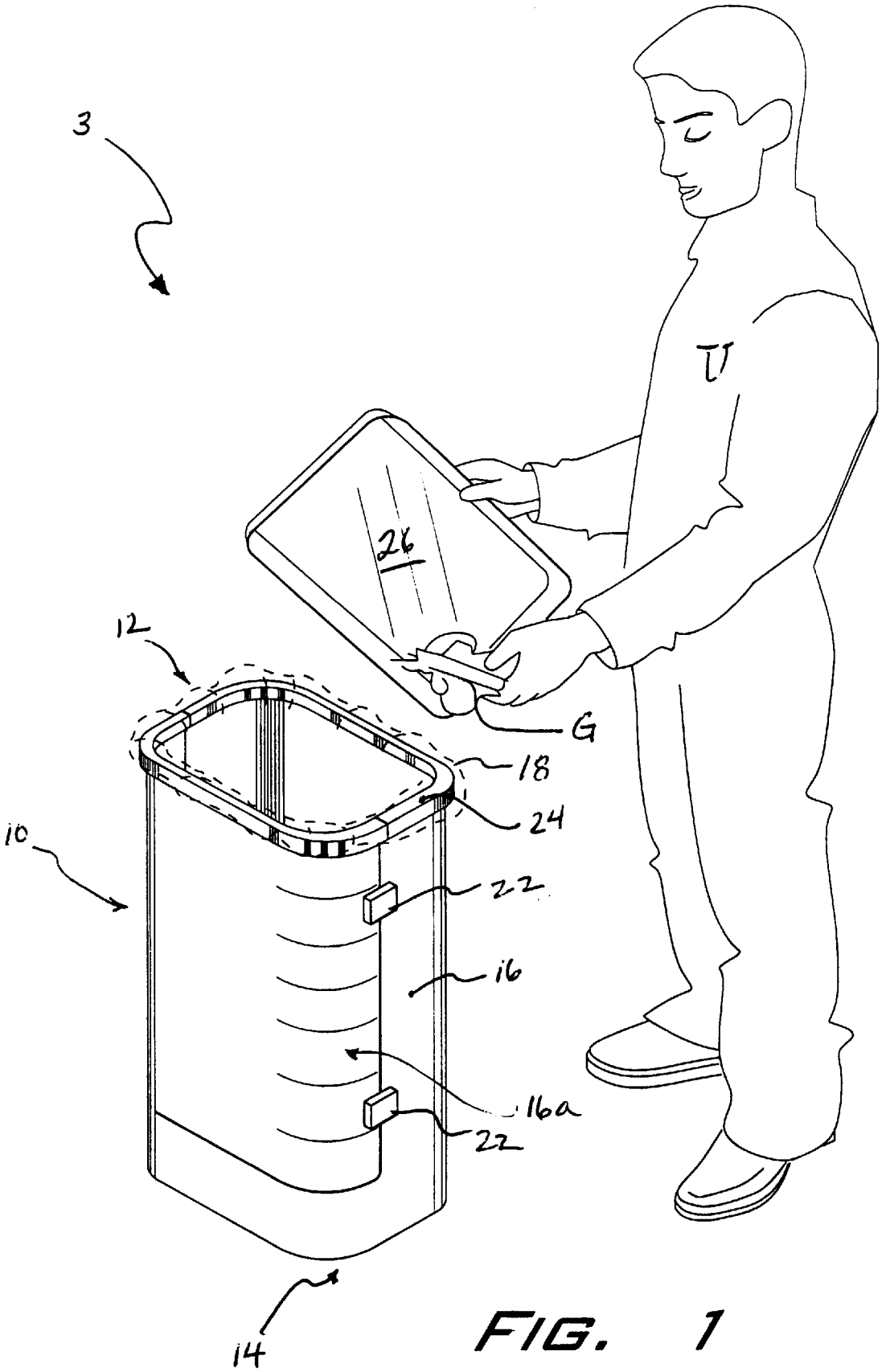
FIG. 1 is an environmental, perspective view of a garbage container according to the present invention.
Figure 2:
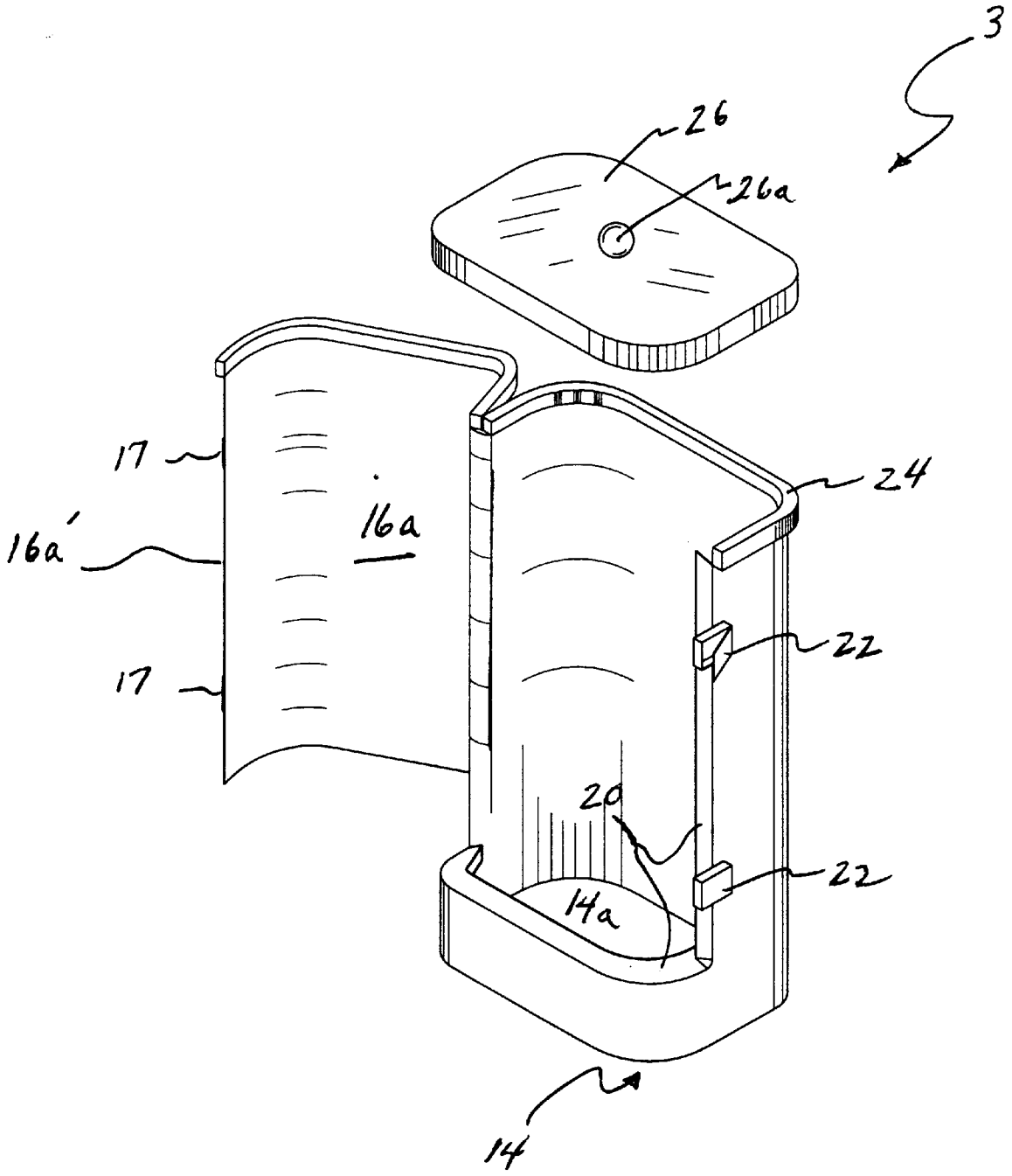
FIG. 2 is a perspective exploded view of the garbage container according to the invention, illustrating lines of attachment of a top lid and an internal lip retainer portion.

As diagrammatically illustrated in FIGS. 1 and 2, the improved refuse container according to the invention comprises a substantially rectangular shaped container 10 having a top portion 12, bottom portion 14 and body portion 16 for retaining refuse. A liner material 18 such as a plastic trash bag is indicated in dotted lines as an insertable container to minimize fluid leakage and the proliferation of germs in a conventional manner. The body portion 16 forms the walls of the container and includes a door 16*a* having at least one fastening means 17 for securing the door 16*a* to the body portion 16 or vice versa as a matter of personal or design preference.

Accordingly, the door 16*a* is contiguously and pivotally formed therewith the body 16 as a single material element with said container. The body portion 16 which incorporates the door 16*a*, further comprises a retaining means 20 disposed on a separate and opposing end of the body portion 16 as diagrammatically illustrated in FIG. 2. The retaining means 20 of the body 16 is preferably disposed therein also as a single contiguous material element for matingly receiving and retaining the door 16*a* along a peripheral edge portion 16*a'* for maintaining the general shape of the container 10 so as to also produce a closed configuration as seen in FIG. 1. The retaining means 20 is a substantially arcuate inverted L-shaped recessed plate shaped and formed as a single contiguous material element with the body 16 via a projection molded process.

Proximate and adjacent the retaining means 20 is disposed within the body at least one connecting means or female snap fastener 22 for respectively connecting thereto the at least one fastening means 17, such as a male type snap fastener a protruding end. Operatively, when the door 16*a* is fastened to the body 16 to produce the closed configuration as shown in FIG. 1, a top retainer ledge 24 is formed within the top portion 12 for retaining a container liner 18, and a top lid 26. The lid having a handle portion 26*a* for removably attaching the lid to the top portion 26. The unique element of improvement includes wherein the pivotal door is an operative living hinge which requires no mechanical elements such as pins and the like associated with mechanical hinges. This technique significantly reduces costs and the overall volume or weight associated with manufacturing (i.e. projection molding) the refuse container as herein disclosed. Thus, as with both male and corresponding female snap fasteners or connectors 17 and 22, respectively, projection molding techniques produce mechanisms integrally and selectively formed within the body 16 as a single contiguous and/or homogeneous material mechanism or element with significantly reduced weight requirements. Such mechanisms are easily adapted to a peripheral edge portion of the door 16*a* via this technique.

Other advantages of the improved refuse container 3 according to the invention includes a basin 14*a* portion formed at the bottom 14 of the container 10 to retain a nominal amount of solid and fluid material without spillover. This basin can include use of deodorizers or disinfectants absorb odors related normal bacteria growth associated with refuse or waste. To minimize weight requirements and to reduce manufacturing costs the improve refuse container 3 and lid 26 are preferably made from a light-weight plastic material.

It is to be understood that the present invention is not limited to the embodiment described above, but encompasses any and all embodiments within the scope of the following claims.

What is claimed is:

1. An improved refuse container comprising:

a substantially rectangular shaped container having a top portion, bottom portion and body portion for retaining refuse, the body portion forms the walls of the container and includes a door having at least one fastening means for securing the door to the body portion, said door being contiguously and pivotally formed therein as a single material element with said container, the body portion including the door, further comprises a retaining means on a separate and opposing end of the body as a single contiguous material element for matingly receiving and retaining said door along a peripheral edge portion of the door so as to produce a closed configuration, proximate and adjacent said retaining means is disposed within the body at least one connecting means for respectively connecting thereto the at least one fastening means, and wherein said body in the closed configuration operatively provides a top retainer ledge within the top portion for retaining a container liner, and a top lid, said lid having a handle portion for removably attaching the lid to said top portion.

2. The improved refuse container according to claim 1, wherein said pivotal door is an operative living hinge.

3. The improved refuse container according to claim 2, wherein said at least one fastening means is a male snap fastener integrally and selectively formed within a peripheral edge portion of the door via a projection molding process.

4. The improved refuse container according to claim 2, wherein said pivotal door is disposed within the body so as to form a basin portion at the bottom of the container to retain a nominal amount of material without spill-over.

5. The improved refuse container according to claim 2, wherein said at least one connecting means is a female snap fastener integrally and selectively formed within a peripheral edge portion of the body via a projection molding process.

6. The improved refuse container according to claim 1, wherein said retaining means is a substantially arcuate inverted L-shaped recessed plate shaped and formed as a single contiguous material element with the body via a projection molded process.

7. The improved refuse container according to claim 1, wherein said container and lid is made of a plastic material.

* * * * *